United States Patent [19]

Harkavy

[11] 4,428,101

[45] Jan. 31, 1984

[54] FASTENING DEVICE

[76] Inventor: Dianne Harkavy, 39 S. Ashby Dr., Livingston, N.J. 07039

[21] Appl. No.: 307,529

[22] Filed: Oct. 1, 1981

[51] Int. Cl.[3] ..... F16G 11/10

[52] U.S. Cl. ..... 24/117; 24/119; 24/140

[58] Field of Search ..... 24/117, 119, 140, 143 R, 24/143 B, 204, 306; 36/50, 54

[56] References Cited

U.S. PATENT DOCUMENTS

| | | | |
|---|---|---|---|
| 647,824 | 4/1900 | Girtanner | 24/117 R |
| 3,618,235 | 11/1971 | Cary | 36/2.5 B |
| 3,947,928 | 4/1976 | Maldonado | 24/143 R |
| 4,058,853 | 11/1977 | Boxer et al. | 24/204 X |
| 4,081,916 | 4/1978 | Salisbury | 36/50 |
| 4,114,297 | 9/1978 | Famolare, Jr. | 36/50 |
| 4,247,967 | 2/1981 | Swinton | 24/143 R |
| 4,291,439 | 9/1981 | Riti | 24/119 |

OTHER PUBLICATIONS

Xerographic Image of Package Lace, 2 Sheets, Nu--Lace, Ltd., 1982.

Advertising and Ordering Information, Nu-Lace, Ltd., undated.

*Primary Examiner*—Robert P. Swiatek

*Attorney, Agent, or Firm*—Vogt & O'Donnell

[57] ABSTRACT

A fastener incorporating a lace and a gripper. The gripper has a patch of a fastener material such as Velcro ®. Areas of complementary fastener material are provided on the lace adjacent the ends thereof. When the lace is engaged with a lace-up article such as a shoe, the fastener material on the lace may be engaged with the fastener material on the gripper to maintain the lace under tension.

17 Claims, 9 Drawing Figures

FASTENING DEVICE

BACKGROUND OF THE INVENTION

The present invention relates to a fastening device for lace-up articles, and to improved lace-up articles incorporating such fastening device.

The term "lace-up article" as used in this disclosure refers to an article having a pair of opposed flaps which may be retained in juxtaposition with one another by means of a lace. An ordinary shoe is one example of such an article and there is a substantial need for an improved fastening device suitable for use on lace-up shoes. Although the ordinary shoelace provides an effective means for fastening opposed flaps of a shoe to one another to bind the shoe to the foot such a lace must be tied and untied in use. This seemingly simple task is beyond the abilities of many people who wear shoes, such as young children and physically handicapped persons. It is also extremely difficult to perform this task while wearing gloves or mittens. Accordingly, there has long been a need for a fastening device which does not require the user to tie a knot. Various devices have been proposed to meet this need.

For example, U.S. Pat. No. 3,947,928 discloses a lace having a plurality of snaps adjacent one end and a plurality of complementary snap receiving members adjacent the other end. When the lace is engaged with a conventional shoe, the snaps may be engaged in the snap receiving members to fasten the ends together and thereby fasten the opposing flaps of the shoe about the foot of the wearer. Such a device, however, provides only a limited range of adjustment and provides only step-wise adjustment over this limited range. Moreover, the snaps or the snap receiving elements must be of a smaller diameter than the lace receiving eyelets in the shoe so that the lace can be threaded through the eyelets. Both the holding power and the ease of engagement of the snaps are correspondingly limited.

U.S. Pat. No. 3,618,235 discloses a shoe having two opposed flaps and a patch of Velcro fastener material on each such flap. A third flap having another piece of Velcro material is arranged so that the tongue may be folded to overlie both flaps. In this position, the Velcro material on the tongue engages the Velcro material on the flaps so that both flaps are fastened to the tongue and thus fastened to one another. As this arrangement requires special constructional features in the shoe itself, it is unsuitable for use with ordinary shoes originally made for use with standard laces.

As described in U.S. Pat. No. 4,081,916, it has also been proposed to provide a lace permanently mounted in a shoe with both ends of the lace being fastened to a single flap of Velcro material. A complementary flap is permanently mounted to the body of the shoe so that the lace may be pulled taut and then secured in position by engaging the flaps with one another. This arrangement also requires a special shoe construction and results in a shoe having a somewhat unconventional appearance.

SUMMARY OF THE INVENTION

The present invention provides a knotless fastening device for lace up articles which does not require any precise alignment of fastening elements, and which is therefore easy to operate. The device provides a wide range of continuous adjustment and also provides a firm securement for the opposing flaps of the article.

The device according to the present invention incorporates a lace having a first area of fastener material adjacent one end and a second area of fastener material adjacent the other end. A gripper having a patch of fastener material is also provided. When the lace is engaged in the lace receiving holes of a conventional lace-up article, the lace may be pulled taut and the two areas of fastener material on the lace may be engaged with the fastener material on the gripper. When both ends of the lace are secured to the gripper in this fashion, the tension in the lace will be maintained.

The term "fastener material" as used in this disclosure refers to material which will releasably engage and adhere to another material upon contact therewith. Ordinarily, fastener materials are provided in sets of opposite, complementary materials. For example, the fastener materials are sold under the registered trademark Velcro include a "hook" material and an "eye" material. The hook material has numerous small plastic hooks projecting from its surface and the eye material has numerous loops or eyes of flexible plastic thread on its surface. When the two materials are pressed into contact with one another, the hooks releasably engage the eyes.

In the device of the present invention, the areas of fastener material on the lace may be elongated in the longitudinal direction of the lace so that they may be engaged with the gripper despite wide variations in the positioning of the lace ends relative to one another, as may be encountered when the device is applied to various shoes or to adjustment of a particular shoe to fit various feet. The lace may be provided with additional areas of fastener material so that such areas are present on both faces of the lace. Thus, even if the lace is twisted, at least one area of fastener material adjacent each end of the lace will be engageable with the gripper. The gripper may also be provided with an additional patch of fastener material and constructed so that the two patches of fastener material on the gripper can be moved between an open position in which the patches are remote from one another and a closed position in which such patches confront one another. The lace can thus be positioned between the opposing patches of fastener material, each patch of fastener material on the gripper being engaged with one area of fastener material adjacent each end of the lace.

Appropriate means may be provided for securing the gripper to a portion of the lace remote from the ends thereof so that the gripper cannot be lost when the engagement between the fastener materials on the lace and the fastener materials on the gripper is released, as when the lace is being loosened.

Some embodiments of the present invention may be utilized as a direct replacement for an ordinary lace without any other modification in the remainder of the article. Such embodiments may be utilized in ordinary lace-up shoes. Alternatively, elements of the fastening device may be integrated with other elements of the article. For example, the gripper may be formed as the tongue of the shoe.

The fastening device of the present invention may be utilized in lace-up articles other than shoes. For example, corsets, orthopedic appliances and the like may incorporate the device to good advantage.

The present invention also includes articles incorporating the new fastening device.

These and other objects, features and advantages of the present invention will be more readily apparent from the detailed description of the preferred embodiments set forth below taken in conjunction with the accompanying drawings.

DETAILED DESCRIPTION OF THE PREFERRED EMBODIMENTS

Figure 1:
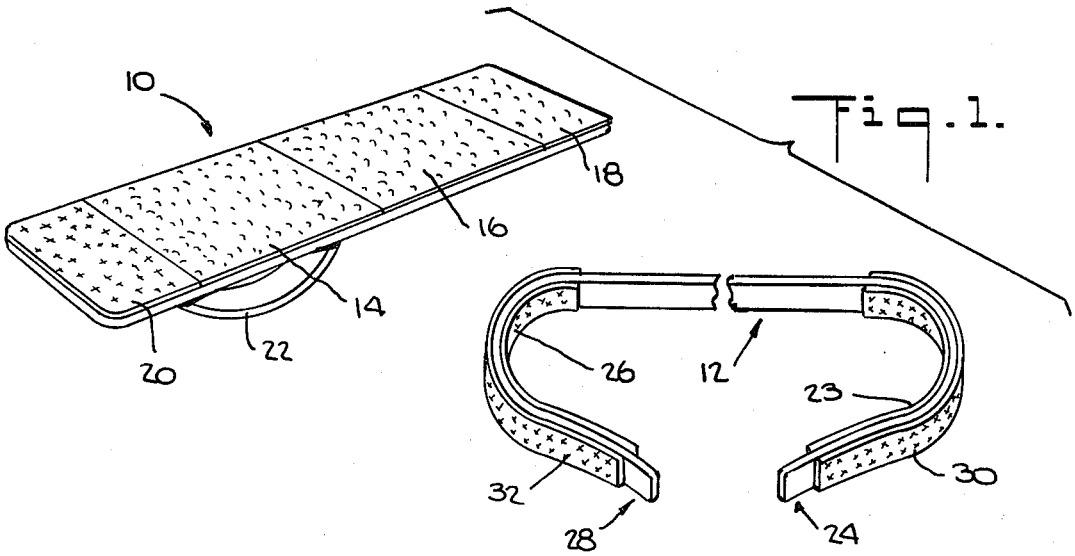
FIG. 1 is a schematic perspective view of a fastening device in accordance with a first embodiment of the present invention.

As shown in FIG. 1, a fastening device according to a first embodiment of the present invention includes a flat, flexible strip-like gripper 10 and a flexible elongated lace 12. Gripper 10 has a first patch 14 of hook-type Velcro material on its front face (the face visible in FIG. 1). On the same face, the gripper also has a second patch of hook-type material 16 adjacent first patch 14 and a third patch of hook-type material 18 adjacent second patch 16. A fourth patch 20 of eye-type Velcro material is disposed on the front face of gripper 10 adjacent first patch 14 at the opposite end of the gripper from third patch 18. A flexible loop 22 is fastened to the rear face of gripper 10 behind first patch 14 and fourth patch 20.

Although the various patches of fastener material are depicted with clearly defined borders for clarity of illustration, such borders are not essential. Thus, the three patches of hook-type material 14, 16 and 18 may all be portions of a unitary piece of hook-type material.

Lace 12 has a first area of eye-type Velcro material 23 on one face adjacent one end 24 and a second area of eye-type material 26 on the same face adjacent the other end 28. A third area of eye-type material 30 is provided on the opposite face of the lace adjacent end 24 and a fourth area of eye-type material is provided on such opposite face adjacent the other end 28.

Figure 4:
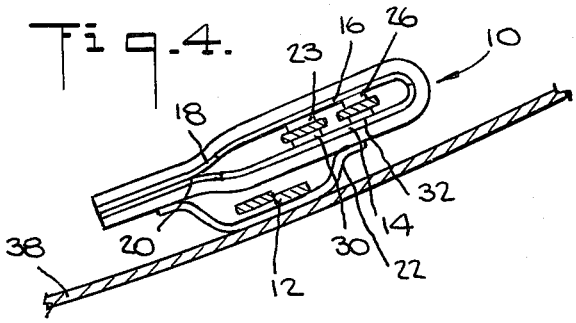
FIG. 4 is a fragmentary, schematic sectional view along line 4—4 in FIG. 2.
Figure 3:
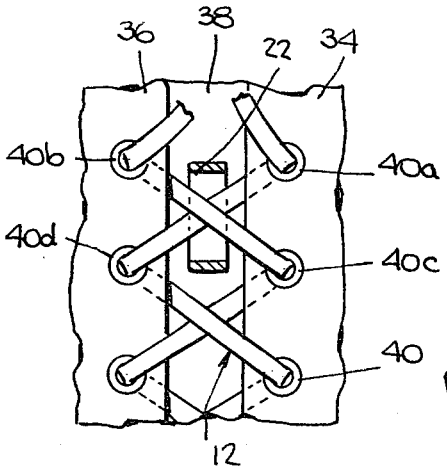
FIG. 3 in a fragmentary view of the fastening device and shoe illustrated in FIG. 2, a portion of the fastening device being removed for clarity of illustration.
Figure 2:
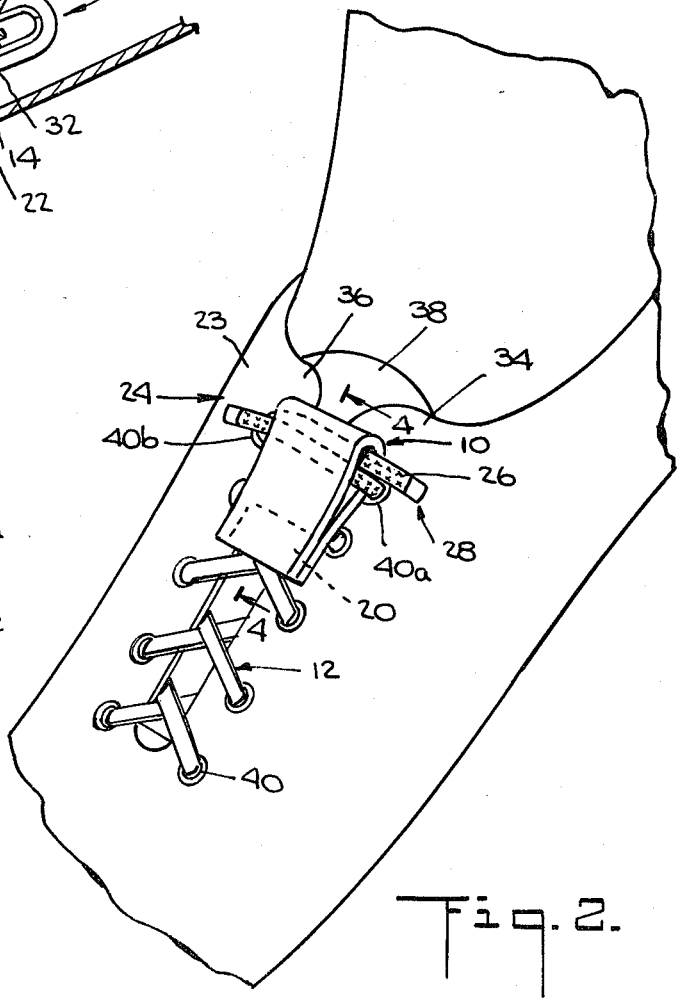
FIG. 2 is a schematic perspective view of the device illustrated in FIG. 1 engaged with a shoe.

As illustrated in FIGS. 2 through 4, the fastener may be engaged with a conventional lace-up shoe having a pair of lacing flaps 34 and 36, a tongue 38 and lacing eyelets 40 in the flaps. The lace is threaded through the eyelets 40 so that the ends 24 and 28 of the lace project beyond the topmost eyelets **40*a* and 40*b* and the lace crosses itself between each pair of eyelets in the conventional manner. As best seen in FIGS. 2 and 3, the loop 22 of gripper 10 is disposed above tongue 38 of the shoe. The portions of lace 12 extending from eyelet 40*c* to eyelet 40*b* and from eyelet 40*d* to eyelet 40*a* pass through loop 22**. The loop thus co-acts with these portions of the lace remote from the ends of the lace to retain the gripper.

When the fastener is in an engaged condition, gripper 10 is folded so that second patch 16 and first patch 14 of hook-type material confront one another. The portions of lace 12 adjacent ends 24 and 28 extend between these confronting patches so that the hook-type material of the first patch 14 on the gripper is in contact with the eye-type material of areas 30 and 32 on the lace, and the hook-type material of second patch 16 on the gripper is in contact with the eye-type material of areas 23 and 26 on the lace. The interengagement of the hook-type material of the two patches and the eye-type material of the four areas on the lace secures the lace against the movement relative to the gripper and retains the tension in the lace. Gripper 10 is retained in its closed or folded position by the adhesion of patches 14 and 16 with the eye-type material of the lace areas 23, 26, 30 and 32, and by interengagement of the hook-type material of third patch 18 with the eye-type material of fourth patch 20.

In the engaged position, the gripper effectively maintains tension in the lace. The tension in the lace tends to slide the eye-type fastener material of the lace across the hook-type material of the gripper. However, the interengaged hook-type and eye-type materials offer an extremely high resistance to any such relative sliding motion. The interengaged hook- and eye-type materials are substantially less resistant to separation by peeling. Any peeling forces which might be produced by the flapping of the loose ends of the lace during vigorous motion of the shoe, as in running, are effectively resisted by the gripper because the gripper engages the lace on both sides. For example, if the loose ends of the lace flap upwardly relative to the shoe, the overlying patch 16 of gripper 10 will retain the lace and prevent any peeling away from patch 14.

To loosen the lace, the wearer merely opens the gripper 10 by peeling third patch 18 away from the fourth patch 20 and peeling second patch 16 away from lace areas 23 and 26. Once this has been accomplished, the wearer may simply grasp the ends of the lace and peel areas 30 and 32 away from first patch 14 of the gripper to release the tension in the lace. Even when the tension in the lace has been released in this fashion, however, the gripper will remain attached to the shoe by virtue of the interengagement between loop 22 and the portions of lace 12 remote from the ends of the lace.

To fasten the lace, the wearer uses a reverse sequence of operations, first pulling on the ends of the lace to establish the desired tension, then engaging the fastener material areas with the first patch on the gripper, then folding the gripper over the lace. Because the gripper is retained on the shoe by the loop, the wearer need not manipulate the gripper while initially pulling the lace and engaging it with the first patch of fastener material on the gripper. Also, the initial engagement with the first patch will provide sufficient security to retain tension in the lace while the wearer is folding the gripper.

The lace may become twisted during use but this will not impair the functioning of the fastening device as each area of eye-type material on the lace will simply be engaged by a different patch of hook-type material on the gripper. Also, the portions of the lace engaged between the opposed patches of the gripper may be crossed or overlapped with one another. In this case, two of the four areas of eye-type material on the lace may overlie one another and therefore may not contact the hook-type material on the gripper. However, at least two of the four areas of the eye-type material on the lace (at least one such area adjacent each end of the lace) will be engaged by the hook-type material of the gripper, and such engagement generally will provide adequate security to maintain tension in the lace.

The extent of areas 23, 26, 30 and 32 on the lace in the longitudinal direction of the lace is greater than the width or smallest planar dimension of patches 14 and 16 on the gripper. Therefore, the eye-type areas on the lace will be engaged with the hook-type material on the gripper over the full width of the gripper despite variations in the position of the lace caused by differing foot sizes and shoe sizes. The range of positions over which such full engagement will be provided depends upon the length of the eye-type fastener material areas on the lace. For the maximum possible range, the eye-type material areas on the lace may extend all the way to the middle of the lace and may merge with one another.

Figure 5:
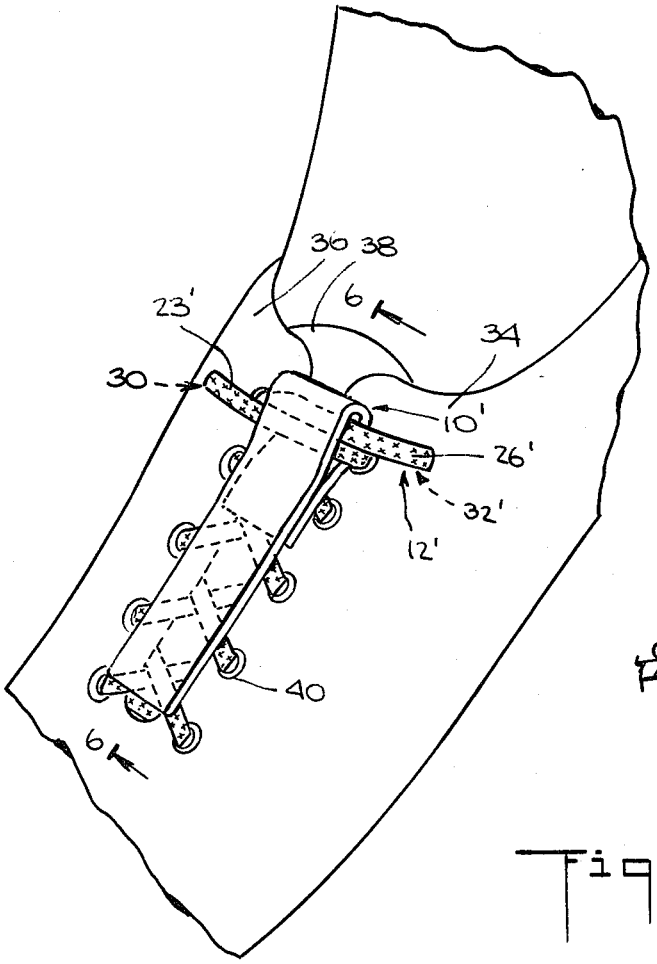
FIG. 5 is a view similar to FIG. 2 but depicting a fastening device according to a second embodiment of the present invention together with a shoe.
Figure 6:
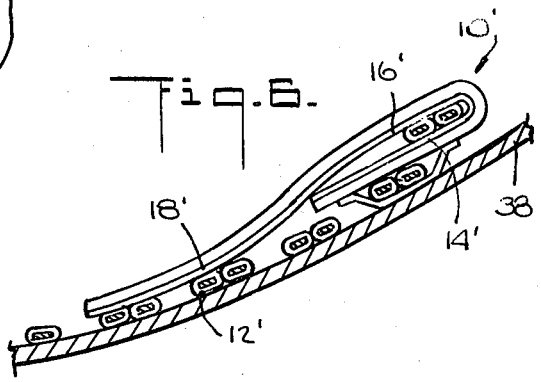
FIG. 6 is a fragmentary sectional view taken along line 6—6 in FIG. 5.

A fastening device according to a second embodiment of the present invention is illustrated in FIGS. 5 and 6. This device incorporates a gripper 10' and a lace 12'. Lace 12' is similar to the lace described above but the four areas 23', 26', 30' and 32' of eye-type material on lace 12' are extended so that they merge with one another and cover the entire exterior surface of the lace. The lace thus has an area of eye-type fastener material covering the portions of the lace remote from its ends, in addition to the areas of eye-type material adjacent to the ends as described above.

The gripper 10' is similar to the gripper described above, except that gripper 10' has only three patches 14', 16' and 18', all of hook-type material. The third patch 18' of hook-type material is elongated so that it extends beyond the first patch 14' when gripper 10' is in its closed or folded position as shown in the drawings. When the fastening device is engaged with a shoe, as illustrated, third patch 18' of hook-type material engages the eye-type material of the lace remote from the ends, such engagement being best illustrated in FIG. 6. This engagement of third patch 18' retains gripper 10' in its closed position. Such engagement also provides additional security against release of the tension in the lace.

Because the entire surface of the lace in this embodiment is covered with the same type of fastener material, the lace can easily be fabricated in a continuous form and then simply cut to desired length. Such length should be selected so as to minimize the length of the lace portions which protrude beyond the gripper and thus minimize flapping of such portions in use. If the fastener material has sufficient strength, the entire lace can be formed from fastener material without any backing or reinforcing material.

Fabrication of the lace entirely from fastener material is ordinarily preferred for simplicity of manufacture. The cross-sectional shape of the lace can be varied as desired. For example, the lace may be flat, as illustrated in the drawings, or round.

As will be readily appreciated, a device according to either of the embodiments described above can be utilized with any conventional lace-up shoe, the ordinary shoelace being replaced by the lace of the fastening device. The gripper can be provided with decorative features on the surface which is normally exposed when the fastener is engaged.

Also, the gripper can be provided with an appropriate score or stitching at the juncture between first and second patches to facilitate folding of the gripper at such juncture.

Although all of the embodiments described above utilize eye-type material for the gripper engaging portions of the lace and hook-type materials for the lace engaging portions of the gripper, other arrangements can be utilized. For example, the lace could be provided with hook-type material and the gripper with eye-type material in the lace engaging patches. Alternatively, other types of fastener materials may be utilized, so long as the materials utilized on the lace will adhere to the materials utilized on the lace engaging portions of the gripper.

Figure 8:
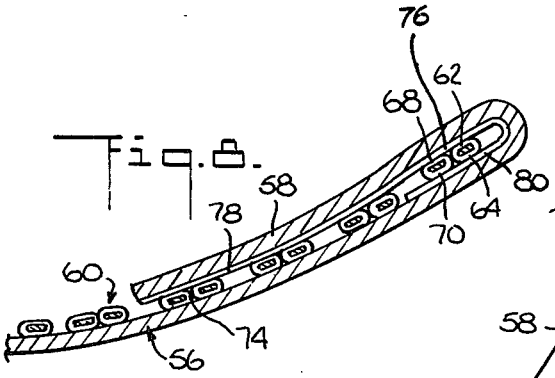
FIGS. 8 and 9 are fragmentary sectional views taken along lines 8—8 and 9—9, respectively, in FIG. 7.
Figure 9:
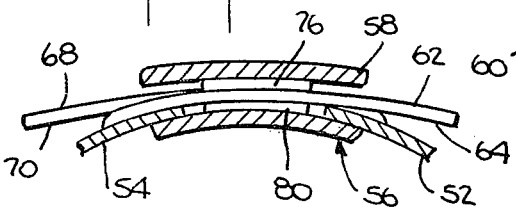
Figure 7:
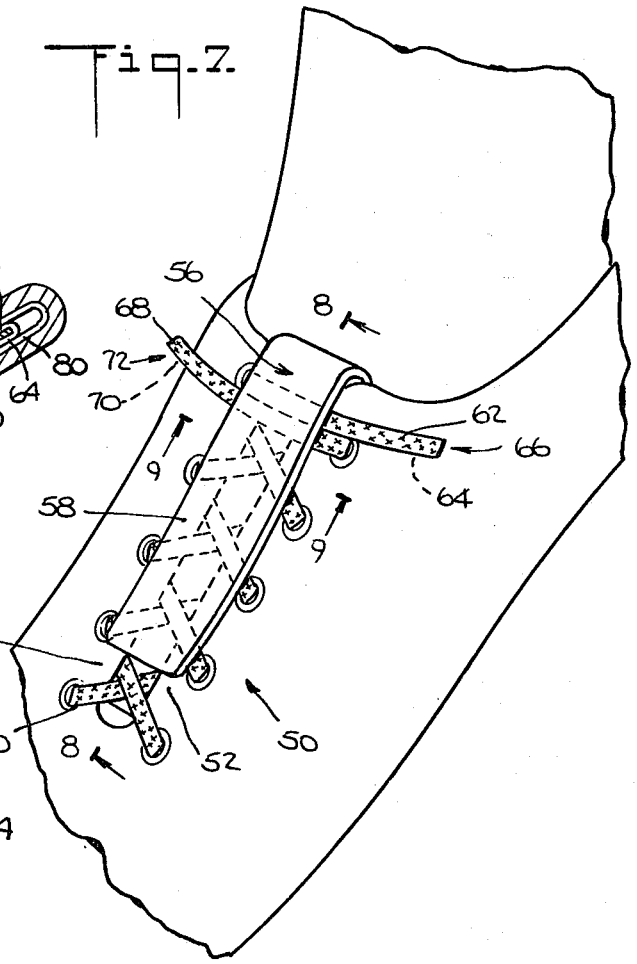
FIG. 7 is a view similar to FIG. 2 but depicting a fastening device according to a third embodiment of the present invention.

A shoe incorporating a fastening device according to a third embodiment of the present invention is illustrated in FIGS. 7 through 9. The shoe includes a body 50 having a pair of opposed flaps 52 and 54. The body of the shoe also includes a tongue 56 which extends along the inside of the flaps and which also extends beyond the flaps. The tongue is flexible so that the portion 58 which extends beyond the flaps may be bent into the folded position as illustrated. In such folded position, the extending portion 58 overlies lace 60 and flaps 52 and 54 on the outside of the shoe. Lace 60 is formed entirely from eye-type Velcro material so that the lace incorporates areas of fastener materials 62 and 64 on opposite faces of the lace adjacent end 66, areas 68 and 70 on opposite faces adjacent end 72 and a zone 74 of fastener material on the portion of the lace remote from the ends thereof.

The tongue 56 of the shoe serves as the gripper of the fastening device. The tongue is provided with a patch of hook-type material 76 on extending portion 58 remote from the tip of such portion and a further patch 78 of hook-type material adjacent the tip of extending portion 58. A further patch of hook-type material 80 (FIGS. 8 and 9) is fastened to the portion of the tongue which is disposed on the inside of the shoe beneath flaps 52 and 54.

When the tongue is in the folded position shown in the drawings, the areas of fastener material adjacent the ends of the lace are disposed between patches 76 and 80. The engagement of such areas with such patches retains the lace under tension. Also, patch 78 adjacent the tip of tongue portion 58 is engaged with zone 74 on the lace. Such engagement retains the tongue in the folded position. The mode of operation of the fastening device incorporated in this shoe is substantially similar to that of the devices described above.

Various portions of the devices described above may be omitted. For example, two of the four areas of eye-type material on the lace illustrated in FIGS. 1–4 may be omitted, and all but the first patch of hook-type material on the gripper in such embodiment may also be omitted. Although such an embodiment would have somewhat less security against accidental loosening, and would be somewhat more difficult to engage if the lace is twisted, it would still be adequate for certain applications. Further, the loop 22 illustrated in FIGS. 1, 2 and 4 may be omitted. In this case, the gripper would not be fastened to the shoe or the lace except by the interengagement between the fastener material on the gripper and the fastener material on the lace. Thus, when such engagement is released, the gripper will be free of the shoe. This arrangement may be desirable if the gripper carries ornamentation and it is desired to change the gripper frequently to provide new ornamentation. However, such an arrangement would be undesirable in the case of a fastener for children's shoes because the gripper could be lost.

In the embodiment of FIGS. 7–9, patches of fastener material 78 and 80 could be omitted, although such omission would make the fastener somewhat less secure.

As these and other combinations and modifications of the features illustrated above can be utilized without departing from the present invention as set forth in the appended claims, the foregoing description of the preferred embodiments should be understood by way of illustration rather than by way of limitation of the present invention.

What is claimed is:

1. A fastening device for a lace-up article comprising:

(a) a gripper having first and second patches of a first type of fastener material, said patches being moveable with respect to one another between a closed position in which said patches confront one another and an open position in which said patches are remote from one another; and (b) a lace having two oppositely-directed faces, said lace having four areas of a second type of fastener material complementary to the fastener material of said first type, two of said areas being disposed on each of said faces, the two areas on each face being disposed adjacent opposite ends of the face so that two of said areas, including one on each of said faces, are disposed adjacent each end of the lace, the fastener material of said patches being engageable with the fastener material of said areas when said lace is engaged with the article and said patches are in said closed position with said areas of said lace disposed therebetween.

2. A device as claimed in claim 1 in which the extent of each of said areas in the longitudinal direction of said lace is greater than the width of each of said patches.

3. A device as claimed in claim 2 in which said areas of fastener material extend to one another and cooperatively cover the entire exterior surface of said lace.

4. A device as claimed in claim 1 in which said gripper is flexible, both of said patches being disposed on one face of said gripper so that said patches may be moved to said closed position by folding said gripper.

5. A device as claimed in claim 4 further comprising a third patch of fastener material on said gripper adjacent said second patch and a fourth patch of fastener material on said gripper adjacent said first patch, the fastener material of said third patch being complementary to the fastener material of said fourth patch, said third and fourth patches confronting and engaging one another when said first and second patches are in said closed position.

6. A device as claimed in claim 4 further comprising a zone of fastener material of said second type on said lace remote from the ends thereof and a third patch of fastener material of said first type on said gripper adjacent said second patch, said third patch overlying and engaging such zone when said first and second patches are engaged with said areas.

7. A device as claimed in claim 1 or claim 4 or claim 5 or claim 6 further comprising means for fastening said gripper to the article independently of the interengagement of said fastener materials.

8. A device as claimed in claim 7 in which said gripper-fastening means includes a loop attached to said gripper, a portion of said lace remote from the ends being engageable in said loop.

9. A device as claimed in claim 8 in which said first patch is disposed on the front face of said gripper and said loop is disposed on the rear face of said gripper.

10. A device as claimed in claim 1 in which one of said first and second types of fastener material is a hook-type fabric and the other one of such types of fastener material is an eye-type fabric.

11. In an article having a body including a pair of flaps, a lace having two oppositely-directed faces and means for engaging said lace with said flaps so that when said lace is maintained under the tension said lace will secure said flaps to one another, the improvement comprising:

(a) a gripper having first and second patches of a first type of fastener material, said patches being moveable with respect to one another between a closed position in which said patches confront one another and an open position in which said patches are remote from one another; and (b) four areas of a second type of fastener material complementary to the fastener material of said first type, on said lace two of said areas being disposed on each of said faces, the two areas on each face being disposed adjacent opposite ends of the lace so that two of said areas, including one on each of said faces, are disposed adjacent each end of the lace, the fastener material of said patches being engageable with the fastener material of said areas when said patches are in said closed position with said areas of said lace disposed therebetween.

12. The improvement as claimed in claim 11 further comprising a loop on said gripper, said gripper being flexible and having front and rear faces, both of said patches being disposed on the front face of the gripper so that said patches may be moved to said closed position by folding said gripper, said loop being disposed on the rear face of said gripper, said flaps being provided with holes, said lace extending through such holes so that portions of said lace remote from the ends thereof cross one another, such crossing portions extending through said loop to secure said gripper to the article.

13. The improvement as claimed in claim 11 further comprising means for releasably retaining said patches in said closed position.

14. The improvement as claimed in claim 11 in which said gripper is permanently fastened to the body of the article.

15. The improvement as claimed in claim 11 in which the article is a shoe, the body of the shoe including a tongue, said patches of fastener material being mounted on said tongue so that said tongue serves as said gripper.

16. The improvement as claimed in claim 15 in which said tongue is flexible and elongated, a portion of said tongue extending beyond said flaps so that the tongue may be bent to a folded position in which said extending portion overlies said lace on the outside of the shoe, one of said patches of fastener material being mounted on said extending portion of said tongue.

17. The improvement as claimed in claim 16 further comprising a zone of said second type of fastener material on said lace remote from the ends thereof and an additional patch of said first type of fastener material on said extending portion of said tongue, said additional patch overlying and engaging said zone when said tongue is in said folded position.

* * * * *